US009970206B1

(12) United States Patent
Nobbe et al.

(10) Patent No.: US 9,970,206 B1
(45) Date of Patent: May 15, 2018

(54) ROOF PLUG

(71) Applicant: VERSCENE, INC., Golden Valley, MN (US)

(72) Inventors: Nick T. Nobbe, Mound, MN (US); Scott C. Van Wey, Maple Grove, MN (US); Kevin J. Bickford, Bloomington, MN (US)

(73) Assignee: Verscene, Inc., Golden Valley, MN (US)

( * ) Notice: Subject to any disclaimer, the term of this patent is extended or adjusted under 35 U.S.C. 154(b) by 0 days. days.

(21) Appl. No.: 15/400,365

(22) Filed: Jan. 6, 2017

(51) Int. Cl.

| | |
|---|---|
| ***E04G 23/02*** | (2006.01) |
| ***E04D 13/16*** | (2006.01) |
| ***E04D 15/02*** | (2006.01) |
| ***E04D 1/30*** | (2006.01) |
| ***E04D 1/34*** | (2006.01) |
| ***E04D 1/22*** | (2006.01) |
| ***E04D 1/20*** | (2006.01) |

(52) U.S. Cl.
CPC ..... *E04G 23/0281* (2013.01); *E04D 1/205* (2013.01); *E04D 1/22* (2013.01); *E04D 1/30* (2013.01); *E04D 1/34* (2013.01); *E04D 13/16* (2013.01); *E04D 15/02* (2013.01); *E04D 2001/308* (2013.01); *E04D 2001/3423* (2013.01); *E04D 2001/3426* (2013.01)

(58) Field of Classification Search
CPC .... E04D 1/30; E04D 1/34; E04D 1/36; E04D 1/205; E04D 15/02; E04D 13/16; E04D 1/22; E04D 2001/3426; E04D 2001/3423; E04D 2001/308; E04G 23/0281; E04G 23/074
See application file for complete search history.

(56) References Cited

U.S. PATENT DOCUMENTS 3,874,505 A * 4/1975 Mirarchi ..... E04G 23/0203 206/231
4,460,420 A * 7/1984 Estrada ..... E04G 23/02 156/152
4,644,723 A * 2/1987 Weber ..... E04G 23/02 52/514

(Continued)

OTHER PUBLICATIONS amazon.com; Kwick Plug; Dec. 3, 2014; https://www.amazon.com/Kwick-Plug/dp/B00QJ08THG/ref=sr_1_1?ie=UTF8&qid=1493644702&sr=8-1&keywords=Kwick+plug. Photographs of the Kwick Plug.

*Primary Examiner* — Babajide A Demuren
(74) *Attorney, Agent, or Firm* — Barnes & Thornburg LLP

(57) ABSTRACT

A roof plug is provided that includes a plug member and a tray member. The tray member includes a recessed portion and a flange portion and is made of a rigid material. The recessed portion includes a base, has at least one opening disposed therein, and has a plurality of side walls each extending upwardly from the base to the flange portion. The flange portion is also oriented outward from a top edge of the plurality of side walls of the recessed portion. The plug member fits into the recessed portion of the tray member. At least one opening in the base provides visual inspection of the plug member when located in the recessed portion. The product serves to plug a hole left behind by a static roof vent when converting to other methods of roof ventilation. Generally, the product can be used to fill any holes in the roof deck sized 8"×8" or 12"×12".

15 Claims, 12 Drawing Sheets

(56) References Cited

U.S. PATENT DOCUMENTS

| | | | | |
|---|---|---|---|---|
| 5,619,836 | A * | 4/1997 | Rouch | E04G 23/0203 411/458 |
| 5,687,528 | A * | 11/1997 | Rouch | E04G 23/0203 52/514 |
| 6,162,525 | A * | 12/2000 | Amy | E04F 21/02 156/71 |
| 6,797,354 | B2 * | 9/2004 | Fleck | B32B 5/18 428/317.1 |
| 6,918,219 | B1 | 7/2005 | Olson | |
| 2003/0228438 | A1 * | 12/2003 | Fleck | B32B 5/18 428/63 |
| 2004/0045245 | A1 * | 3/2004 | O'Brien | E04G 23/0203 52/514 |

* cited by examiner

ROOF PLUG

TECHNICAL FIELD AND SUMMARY

The present disclosure relates to roofs, and in particular to roof plug assemblies that patch holes in roof sheathing.

An illustrative embodiment of the present disclosure provides a roof plug assembly that is configured to fill an opening or hole in roof sheathing. In an illustrative embodiment, the plug assembly is made from a tray portion made from metal such as steel or a rigid galvanized steel, or like material that can be placed over the opening in the sheathing and fastened to same about the hole or opening's periphery. A recessed portion in the tray fits in the opening in the sheathing. A plug member, made of a material similar, compatible, or the same as the sheathing material may be secured in the recessed portion of the tray. In another embodiment, such securement of the plug with the recessed portion of the tray can be made via barbs or other like structures extending upwardly from the base of the recessed portion and engage the bottom surface of the plug member. In other embodiments, fasteners may be disposed through portions of the tray and extend into the plug member to secure same to the tray.

An illustrative embodiment of the present disclosure provides a roof plug assembly which comprises a plug member and a tray member. The tray member includes a recessed portion and a flange portion. The tray member is also made of galvanized steel. The recessed portion includes a base having at least one opening disposed therein. The base is composed of a plurality of panels such that at least a portion of each the plurality of panels is spaced apart from each other. Space between each of the plurality of panels form the at least one opening disposed in the base. The recessed portion includes a plurality of side walls each extending upwardly from one of the plurality of panels of the base to the flange portion. A plurality of upward extending barbs is located on each of the plurality of panels and extends into the recessed portion. The flange portion is oriented outward from a top edge of the plurality of side walls of the recessed portion. The flange portion also includes a plurality of fastener holes disposed therein configured to receive fasteners that secure the roof plug assembly onto a roof. The plug member fits into the recessed portion and is supported by the plurality of panels. The plurality of upward extending barbs extend into the plug member to secure it to the recessed portion. The at least one opening in the base provides visual inspection of the plug member when located in the recessed portion.

In the above and other embodiments, the roof plug assembly may comprise one or more of: the recessed portion having a polygonal profile; the recessed portion having a profile selected from the group consisting of square and rectangular; the plurality of fastener holes sized to receive a fastener selected from the group consisting of a screw, nail, pin, staple, and bolt; the plug member being made of a material selected from the group consisting of plywood, chipboard, and cellulose-based; the tray member being made of a 24 gauge galvanized steel; and the recessed portion including corners composed of right angles.

Another illustrative embodiment of the present disclosure provides a roof plug assembly which also comprises a plug member and a tray member. The tray member includes a recessed portion and a flange portion. The tray member is made of a rigid material. The recessed portion includes a base having at least one opening disposed therein and a plurality of side walls each extending upwardly from the base to the flange portion. The flange portion is also oriented outward from a top edge of the plurality of side walls of the recessed portion. The plug member fits into the recessed portion. And the at least one opening in the base provides visual inspection of the plug member when located in the recessed portion.

In the above and other embodiments, the roof plug assembly may further comprise: one or more of: the tray member being made of galvanized steel; the base being composed of a plurality of panels such that at least a portion of each the plurality of panels is spaced apart from each other; and wherein space between each of the plurality of panels form the at least one opening disposed in the base; a plurality of upward extending barbs located on the base and extending into the recessed portion and extend into the plug member to secure it to the recessed portion; the flange portion including a plurality of fastener holes disposed therein configured to receive fasteners that secure the roof plug assembly onto a roof; the recessed portion including corners composed of right angles; and the plug member being made of a material selected from the group consisting of plywood, chipboard, and cellulose-based.

Another illustrative embodiment of the present disclosure provides a method of forming a roof plug assembly. The method comprises the steps of: providing a sheet of rigid material; cutting a first portion of the sheet of rigid material to form a hole in the sheet of rigid material; cutting the first portion of the sheet of rigid material to define at least one base panel and wall portions; stamping the first portion of the sheet of rigid material to form a recessed portion composed of the at least one base panel, the side walls, and the hole; and forming a flange portion from a second portion of the sheet of rigid material not stamped, wherein the flange portion is located about a periphery of the recessed portion.

In the above and other embodiments, of forming the roof plug assembly may further comprise: the sheet of rigid material being galvanized steel; the step of forming a plurality of fastener holes in the flange portion; the recessed portion being square shaped and having right angle corners; and the steps of cutting the first portion of the sheet of rigid material to define a plurality of base panels; and placing a plug member made of a wood material in the recessed portion.

It is believed that the roof plug assembly may include one or more of the following advantages: sturdy flanges not susceptible to waving or flex in light of the steel tray; the tray being able to accept standard cut roof plugs by having square corners; square corners that eliminate gaps that would allow water to enter; easy attachment to the roof using pre-formed fastener or nail holes; displays plug member from underneath to allow inspection through open underside tray; easy securement of plug member to tray using pre-installed barbs or like fasteners that eliminate the need for adhesives, staples, or other fastening means; more durable and resilient tray when using metal rather than plastic; and increased weight capacity from about 600 to about 700 pounds is believed achievable using a metal tray; a longer lifetime bond for the plug member is believed achievable using barbs as the attachment means rather than glue; a better fastening means in cyclical hot/cold weather environments is also believed achievable using barbs as the attachment means; eliminates perception the hole was patched with sheet metal, and is believed to possibly reduce or eliminate condensation on the backside of the plug during cold temperatures.

Additional features of the present disclosure will become apparent to those skilled in the art upon considering the following description exemplifying the disclosure as presently perceived.

DESCRIPTION OF THE DRAWINGS

The present disclosure will be described hereafter with reference to the attached drawings which are given as non-limiting examples.

Corresponding reference characters indicate corresponding parts throughout the several views. The exemplification set out herein illustrates various embodiments of the disclosure, and such exemplification is not to be construed as limiting the scope of the disclosure in any manner.

DETAILED DESCRIPTION

The figures and descriptions provided herein may have been simplified to illustrate aspects that are relevant for a clear understanding of the herein described structures, while eliminating, for the purpose of clarity, other aspects that may be found in typical structures. Those of ordinary skill may recognize that other elements and/or operations may be desirable and/or necessary to implement the structures described herein. Because such elements and operations would be known in the art, and because they do not facilitate a better understanding of the present disclosure, a discussion of such elements and operations may not be provided herein. The present disclosure, however, is deemed to inherently include all such elements, variations, and modifications to the described aspects that would be known to those of ordinary skill in the art.

Figure 1:
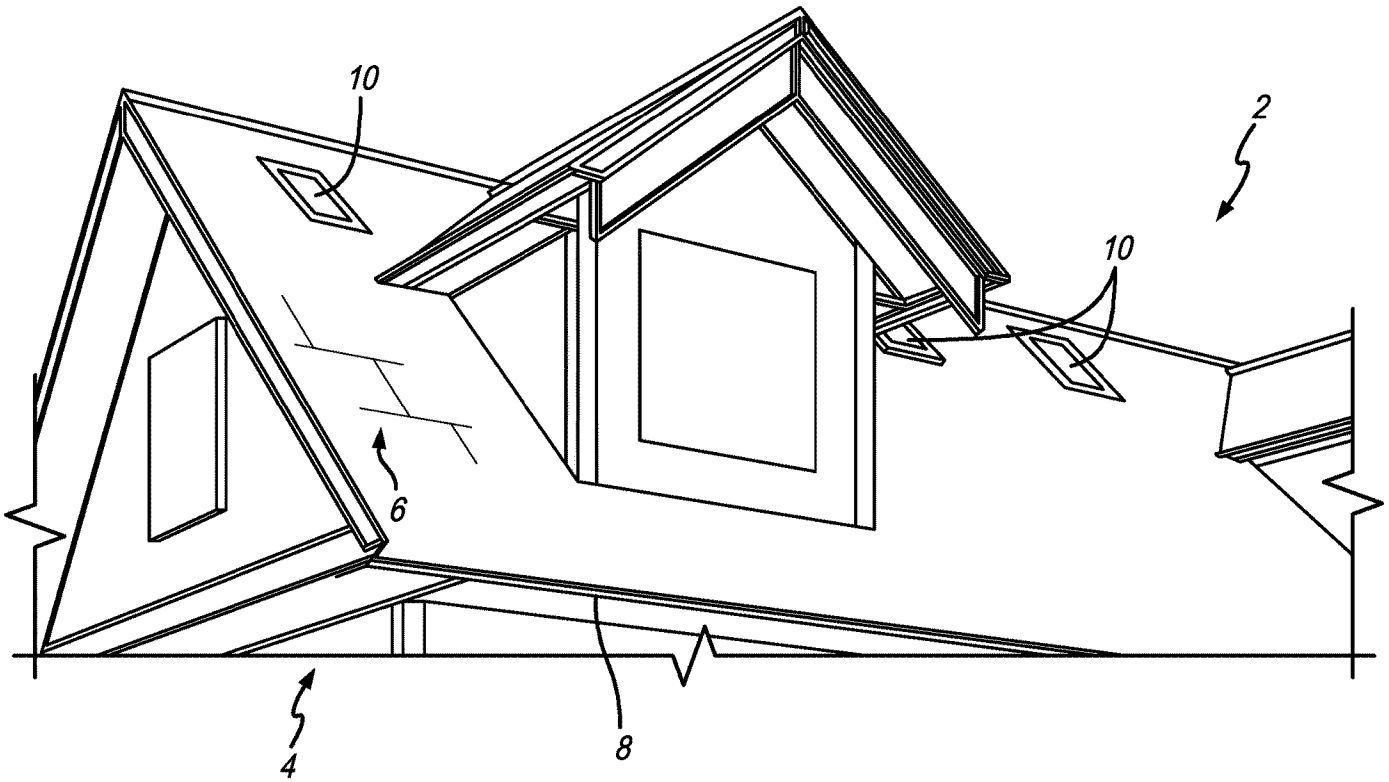
FIG. 1 is a perspective view of a roof that is part of a dwelling, with roof plug assemblies attached thereon.

A perspective view of a roof 2 that is part of a dwelling 4 is shown in FIG. 1. Roof 2 includes shingles 6 that may be applied on top of sheathing 8 that forms the surface of the roofing structure. A plurality of roof plug assemblies 10 are shown fixed onto sheathing 8 of roof 2. It is appreciated that each roof plug assembly 10 is configure to patch a hole in roof sheathing 8. Often times, static roof vents (not shown) may be employed on roofs to provide circulation in the space underneath. Sometimes these static roof vents are replaced by other means of ventilation such as a ridge vent. Under these circumstances the static roof vent is removed and discarded which leaves a hole in the roof. Such a hole is typically too large to effectively place a covering such as a plurality of shingles 6 over. Roof plug assembly 10 is configured to fill such holes in roof sheathing. Roofing materials such as shingles can then be applied over top, and even nailed into plug assembly 10. It is also appreciated that roof plug assembly 10 may be used to plug holes or other like damage formed in roofs caused by other circumstances such as environmental damage or age.

Figure 2:
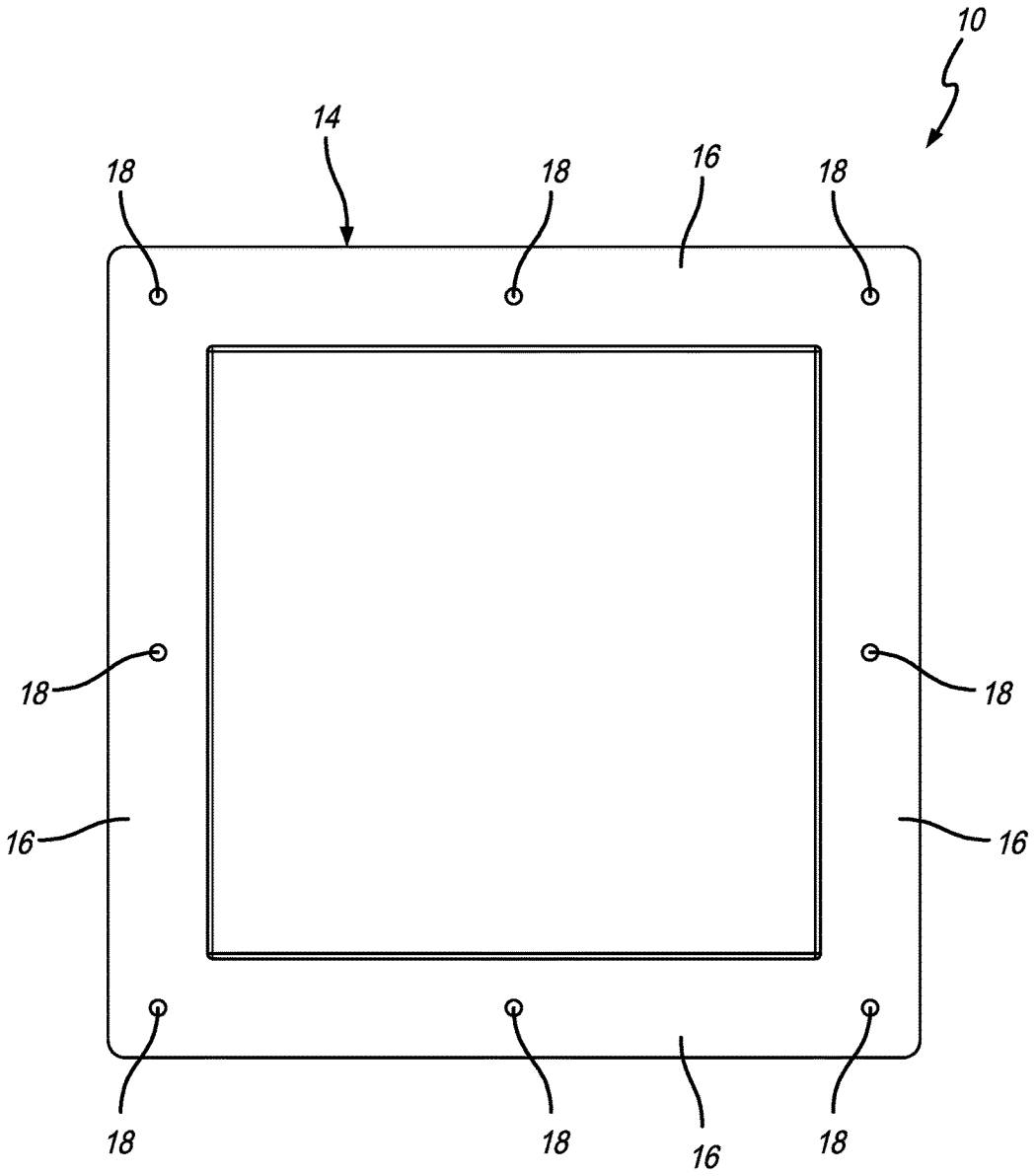
FIG. 2 is a top view of an illustrative embodiment of the roof plug assembly shown in FIG. 1.

A top view of an illustrative embodiment of roof plug assembly 10 is shown in FIG. 2. The primary components of roof plug assembly 10 include a plug member 12 and tray 14. Tray 14 receives plug member 12 and attaches to the roof sheathing surrounding the hole. Plug member 12 may be made from a plurality of industry-accepted roofing materials such as plywood, solid wood, and chip board, oriented strand board (OSB), medium-density fibreboard (MDF), particleboard, or other like material having substantially the same thickness as the sheathing and can hold a fastener. Indeed, the material for plug member 12 may be changed to match the sheathing material on a particular roof. Tray 14 receives plug member 12 and includes flange portions 16 that extend illustratively in all lateral directions from plug member 12 as shown. It is appreciated that flanges 16 is made of a rigid metal material such as steel, galvanized steel, galvalum, non-ferrous metal such as copper, or other suitable metals. Flanges 16 extend from each side of plug member 12 to provide a secure attachment onto roof sheathing 8. Because it is contemplated tray 14 is made from metal, fastener holes 18 are illustratively preformed therein to provide a mechanism to securely fasten plug assembly 10 onto sheathing 8. It is further appreciated that rigid metal rather than a plastic is used for the flanges such as flanges 16 of tray 14 because rigid metal provides added strength over plastic, especially in the instance when the hole in the roof deck is sized larger than specified by the roof plug manufacturer. Metal also provides greater resistance to warping, cracking and degradation over time than plastic. It is also appreciated that having plug member 12 made from the same or similar material to the roofing material still allows shingles, or the like to be nailed onto roof plug assembly 10 just as if it were part of the roof itself.

Figure 3:
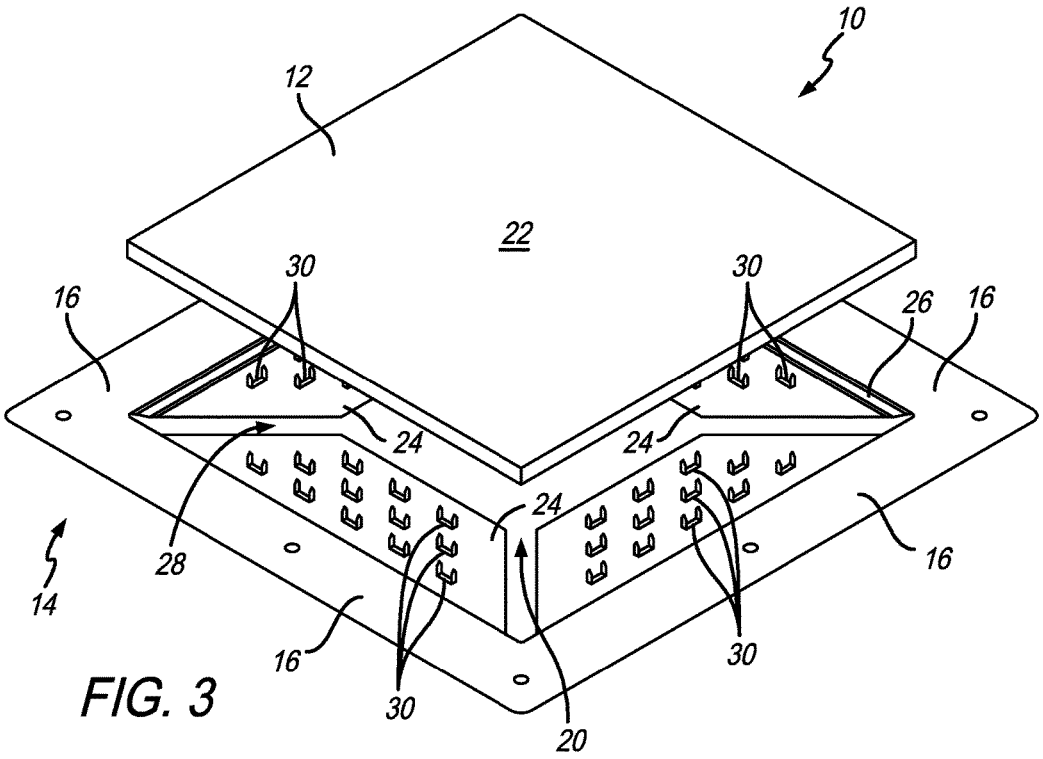
FIG. 3 is an exploded top perspective view of the roof plug assembly of FIG. 1.

An exploded top perspective view of roof plug assembly 10 is shown FIG. 3. This view further depicts a configuration of plug member 12. In this illustrative embodiment, it is a square. It is appreciated, however, that both plug member 12 and tray 14 may be reconfigured in a rectangular or other polygonal-type shape to fit holes of corresponding shape. It will also be appreciated by the skilled artisan that because of the polygonal shape of plug member 12, it will be convenient for a roofer to simply cut a piece of roof material to fit in tray 14, if desired. In an alternative embodiment, plug number 12 may accompany the roof plug assembly 10.

With respect to tray 14, it is configured to also include a recessed portion 20 configured to receive plug member 12. Recessed portion 20 is configured in such a way so that top surface 22 of plug member 12 will be generally flush with flange portion 16 so plug assembly 10 can be generally as flush as possible with sheathing 8 (see, also, FIG. 1). In an illustrative embodiment, recessed portion 20 may have a depth sufficient to accommodate a typical sheathing thickness of 7/16 inch. Other thicknesses may include ½ inch and ¾ inch, for example. It is appreciated, however, that recessed portion 20 may be shallower or deeper depending on the requirements needed for plug member 12.

Illustrative recessed portion 20 includes support bases 24 that extend from each side of tray 14. An illustrative embodiment, tray 14, being made of galvanized steel, such as 24 gage steel, or other like metal can be stamped in to shape. This means that connecting each support base 24 to flange 16 is a sidewall 26. Accordingly, each support base 24 and sidewall 26 extending from each side of tray 14 forms cavity 28 within which plug 12 sits. Having recessed portion 20 in the form of cavity 28 is what allows top surface 22 of plug 12 to be located essentially flush with flange portion 16 of tray 14.

To help secure plug 12 onto tray 14, a plurality of barbs 30 are formed in each of support bases 24 in recessed portion 20 and extend upwardly into cavity 28. It will be appreciated by the skilled artisan upon reading this disclosure that placing plug 12 into cavity 28 of recessed portion 20 and applying a downward force against barbs 30 will cause same to penetrate the material used for plug number 12 thereby securing same in cavity 28. In the illustrated embodiment, the plurality of barbs 30 includes multiple sets of dual upward-extending barbs positioned in rows in each of support bases 24. It is appreciated, however, that such arrangement of barbs could be random or in other patterns. It is further appreciated that the actual shape and size of each barb shown herein is illustrative and may be other configurations that still serve the purpose of securing plug member 12 into cavity 28 of tray 14. In other illustrative embodiments, plug member 12 may be secured in cavity 28 via fasteners.

Figure 4:
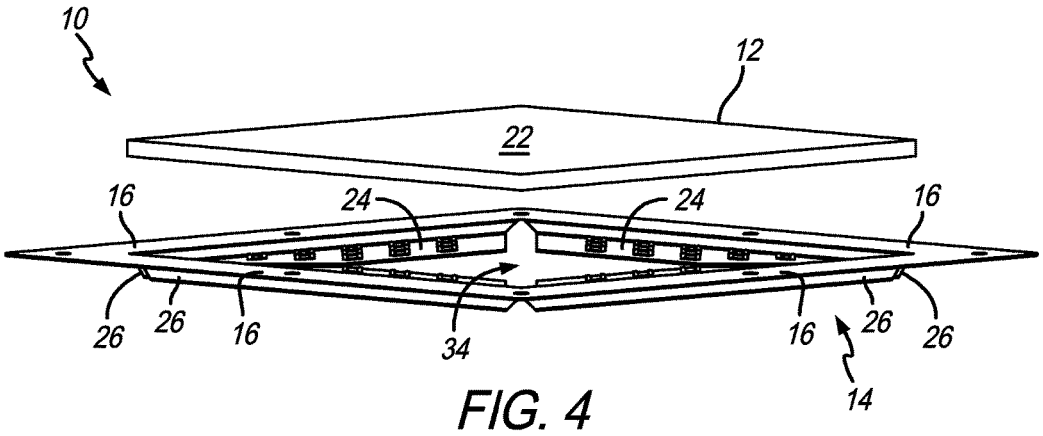
FIG. 4 is an exploded side perspective view of the plug assembly.

An exploded side perspective view of plug assembly 10 is shown in FIG. 4. This view, similar to that of FIG. 3, shows plug member 12 separated from tray 14. This view also shows flanges 16 and recessed portion 20 forming cavity 28 via support bases 24. Further shown is how sidewalls 26 depend downward from flange 16 to form cavity 28.

Figure 5:
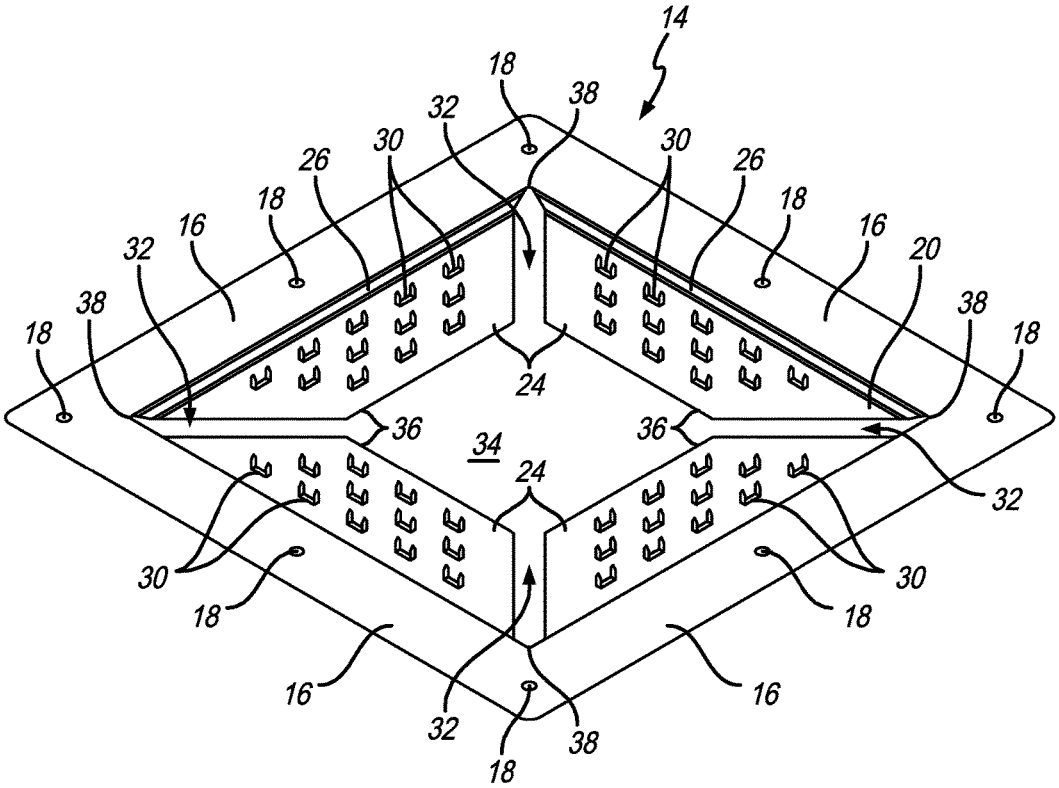
FIG. 5 is a top perspective view of a tray portion of the plug assembly.

A top perspective view of tray 14 is shown in FIG. 5. Similar to that previously discussed, this view shows recessed portion 20 composed of support bases 24 connected to sidewalls 26 depending from flanges 16 to form cavity 28. Further depicted in this view are slots 32 located between adjacent support bases 24 and extending into opening 34. Opening 34 is formed by the leading edges 36 of each support base 24. Such opening 34, as discussed further herein, has a utility of allowing visual inspection of the underside of plug number 12. Slots 32 also assist in providing visual inspection of the underside of plug member 12 but also exist because of the illustrative manufacture of tray 14. In an illustrative embodiment, cavity 28 of tray 14 includes corners 38 that are illustratively right-angle vertexes. Creating such 90 degree corners has a utility in that the plug member 12 may be cut as a square, rectangle, or other polygon that has sharp vertexes. This is a convenient way to make a plug from a manufacturing perspective.

A method of making tray 14 from galvanized steel may include starting with a sheet of such steel and cutting lines in it from vertex 38 to vertex 38 crossways, and then cutting out opening 34. From there, recessed portion 20 may simply be stamped out forming sidewalls 26 and support base 24. The result is the 90 degree corners of vertexes 38 and slots 32. To that end, having 90 degree corners in a steel or other metal tray as well as a means for visually inspecting the underside of that tray, creates an advantage for this plug assembly design. Also shown in this view are the rows of barbs 30.

Figure 6:
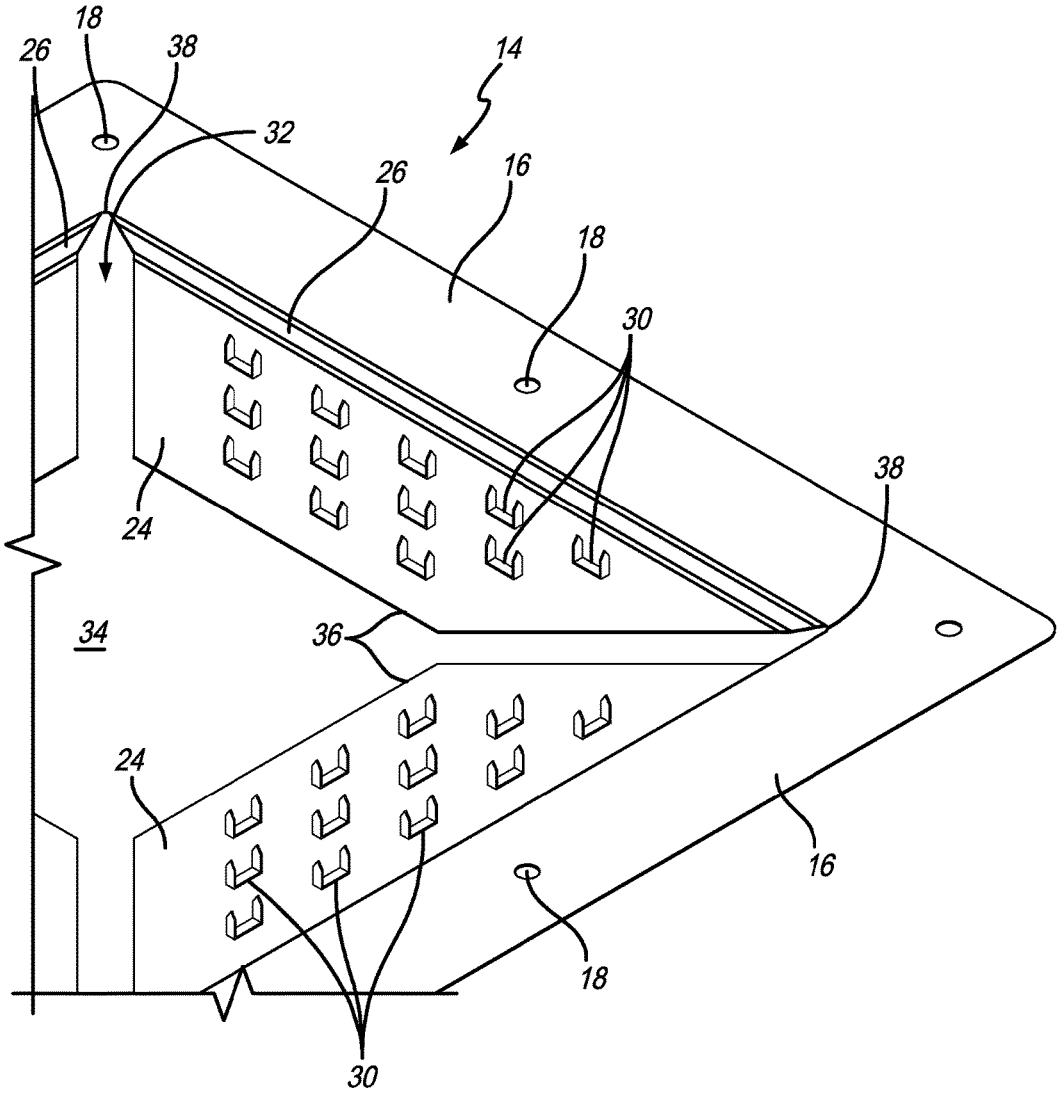
FIG. 6 is a perspective detail view of a portion of the tray of the plug assembly shown in FIG. 5.

A perspective detailed view of a portion of tray 14 is shown in FIG. 6. This view, in particular, shows vertex 38 and slot 32 formed while stamped support base 24 and sidewall 26 are formed in the position as shown. Particularly, in an illustrative embodiment, support base 24, sidewall 26, and flange 16 are all made from a single sheet of metal that is bent to form those specific structures. Also shown in this view are fastener holes 18 and barbs 30.

Figure 7:
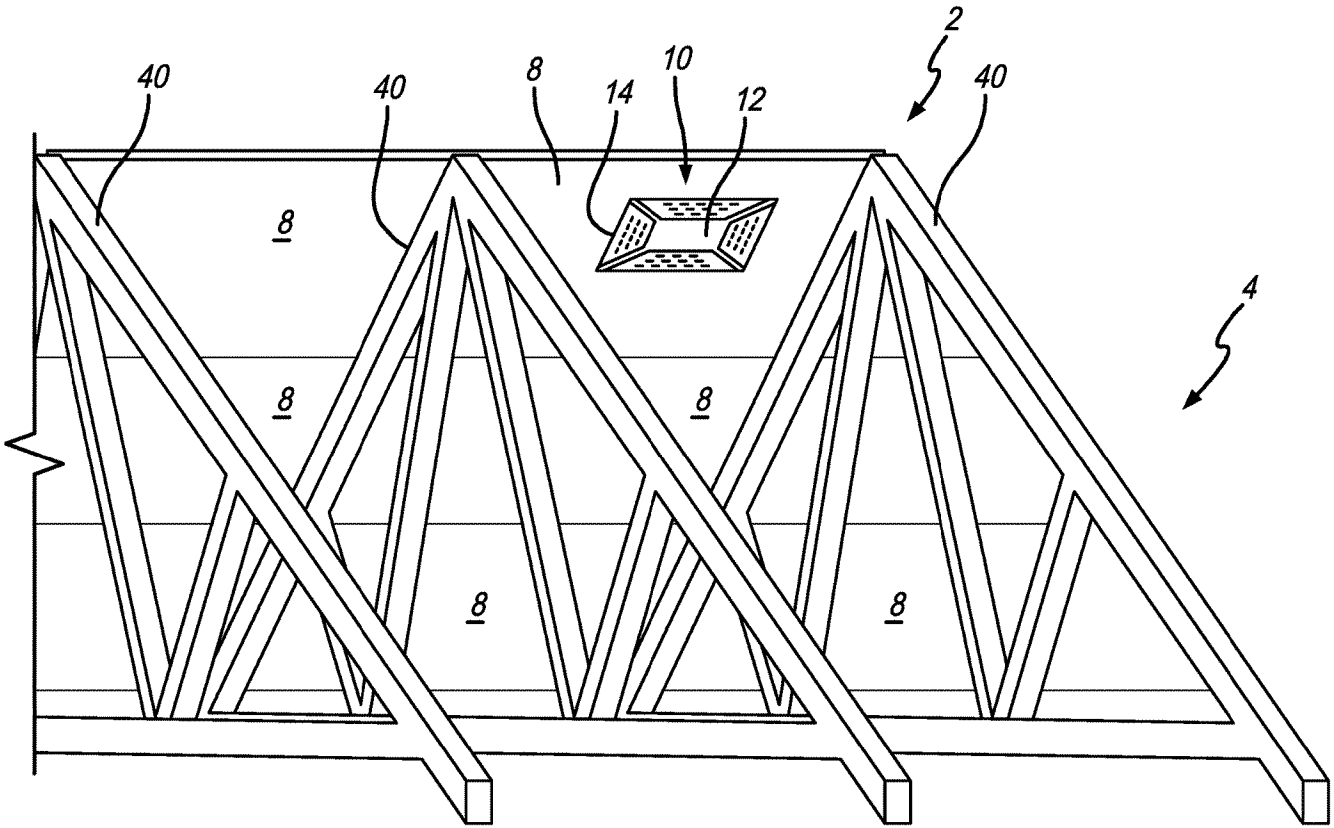
FIG. 7 is an upward interior view of the roof of the dwelling shown in FIG. 1.

An upward interior view of roof 2 in dwelling 4 is shown in FIG. 7. This view depicts sheathing 8 being held by trusses 40. Also shown in this view is a roof plug assembly 10 disposed in sheathing 8. As mentioned, a utility of roof plug assembly 10 is that plug member 12 may be visually observed from the underside of roof 2. In some instances, it may be necessary to visually inspect a roof plug. At the same time, however, during roof construction it may occur that shingles or other roof covering may be applied onto sheathing 8 prior to any inspection. Roof plug assembly 10 accommodates this circumstance by allowing the visual inspection of plug member 12 inside dwelling 4 even when the shingles or other roof covering has already been applied to roof 2. As shown herein, all that is needed is to look upwards and the shape size and material makeup of plug member 12 can be determined while already installed on roof 2.

Figure 8:
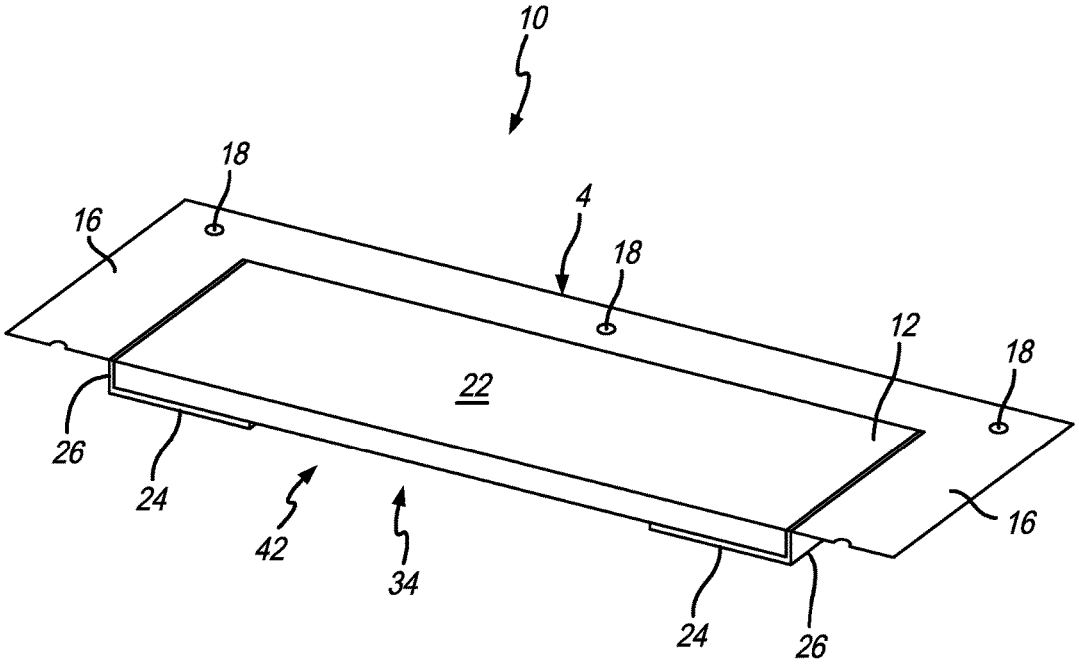
FIG. 8 is a cross sectional perspective view of the plug assembly.

A cross-sectional perspective view of a portion of plug assembly 10 is shown in FIG. 8. It is appreciated that this view is taken along the illustrative centerline of plug assembly 10. This view depicts, however, how top surface 22 of plug member 12 is relatively flush with flange portion 16 of tray 14. In addition, plug member 12 is visible from the underside of plug assembly 10 as indicated by reference numeral 42. Here, because of depending sidewalls 26 and support base 24 as previously discussed, plug member 12 fits into cavity 28 so top surface 22 of plug member 12 remains relatively flush with flanges 16. Also, because support bases 24 form opening 34 in tray 14, the underside of plug member 12 is exposed and visible.

Figure 9:
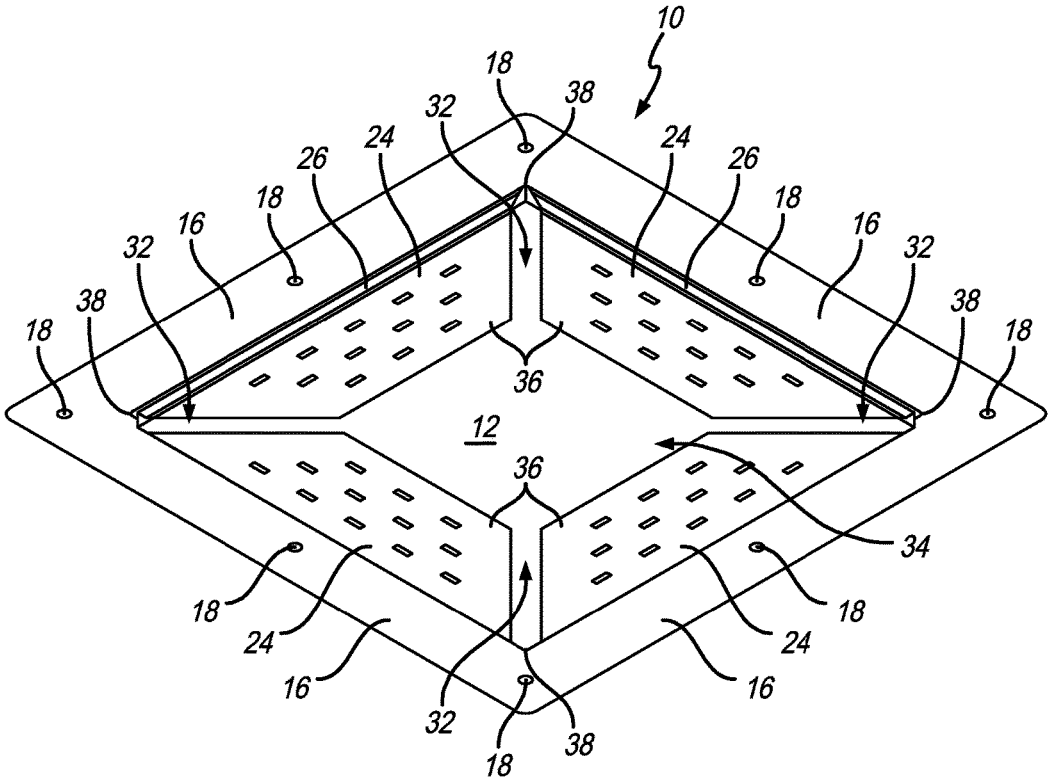
FIG. 9 is an underside perspective view of the plug assembly.

An underside perspective view of plug assembly 10 is shown in FIG. 9. This view is similar to the view that would be seen when viewing the plug assembly 10 installed on roof 8. As shown, plug assembly includes tray 14 and plug member 12. As previously discussed, plug member 12 fits in recessed portion 20 and is visible through opening 34 and slots 32. Plug member 12 is supported by support bases 24. Again, this is helpful when inspecting the roof plug to make sure it is fitted properly within the hole in the roof. Also shown are the illustrative 90 degree angle vertexes formed at the corners of cavity 28 that receives plug member 12 (see also FIG. 3).

Figure 10:
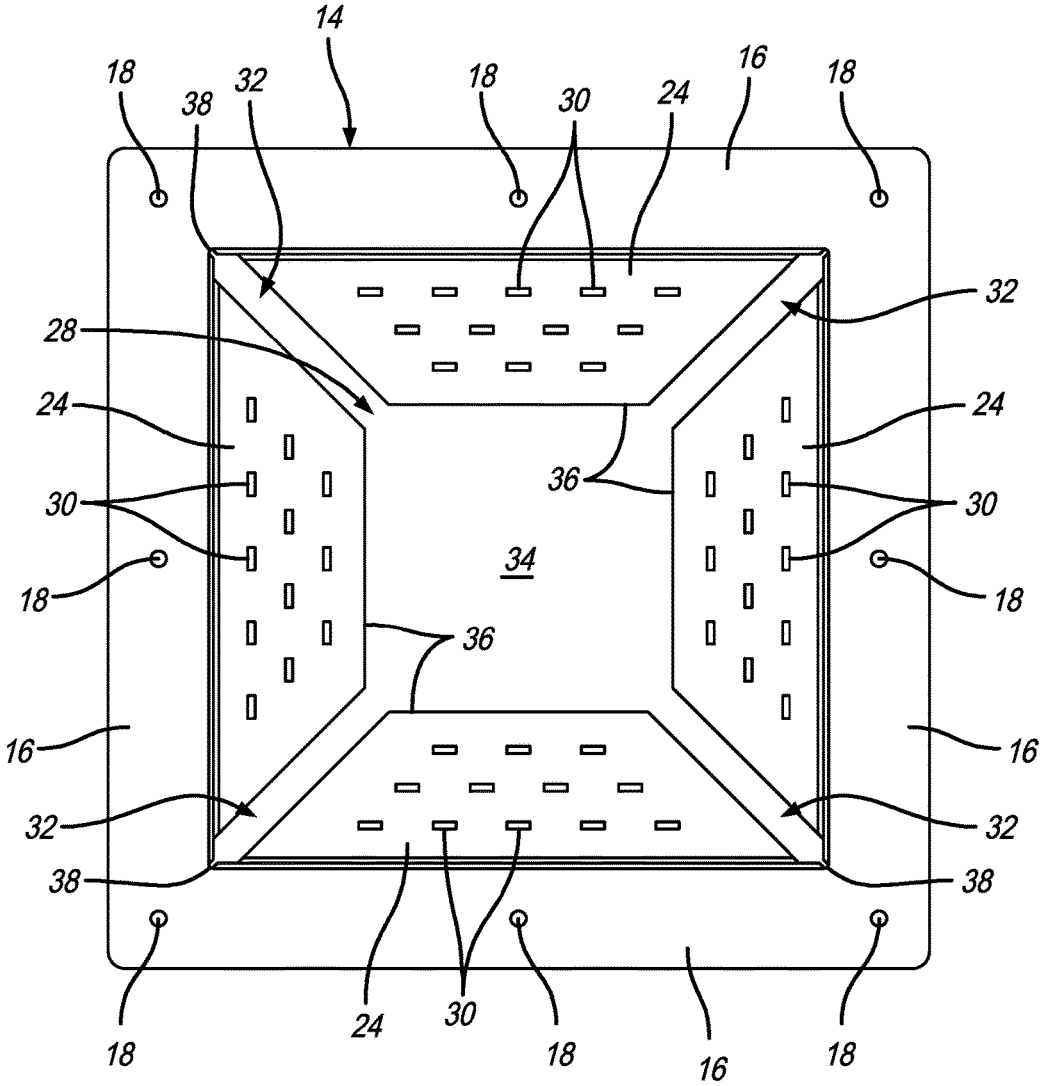
FIG. 10 is a top view of the tray portion of the plug assembly.
Figure 11:
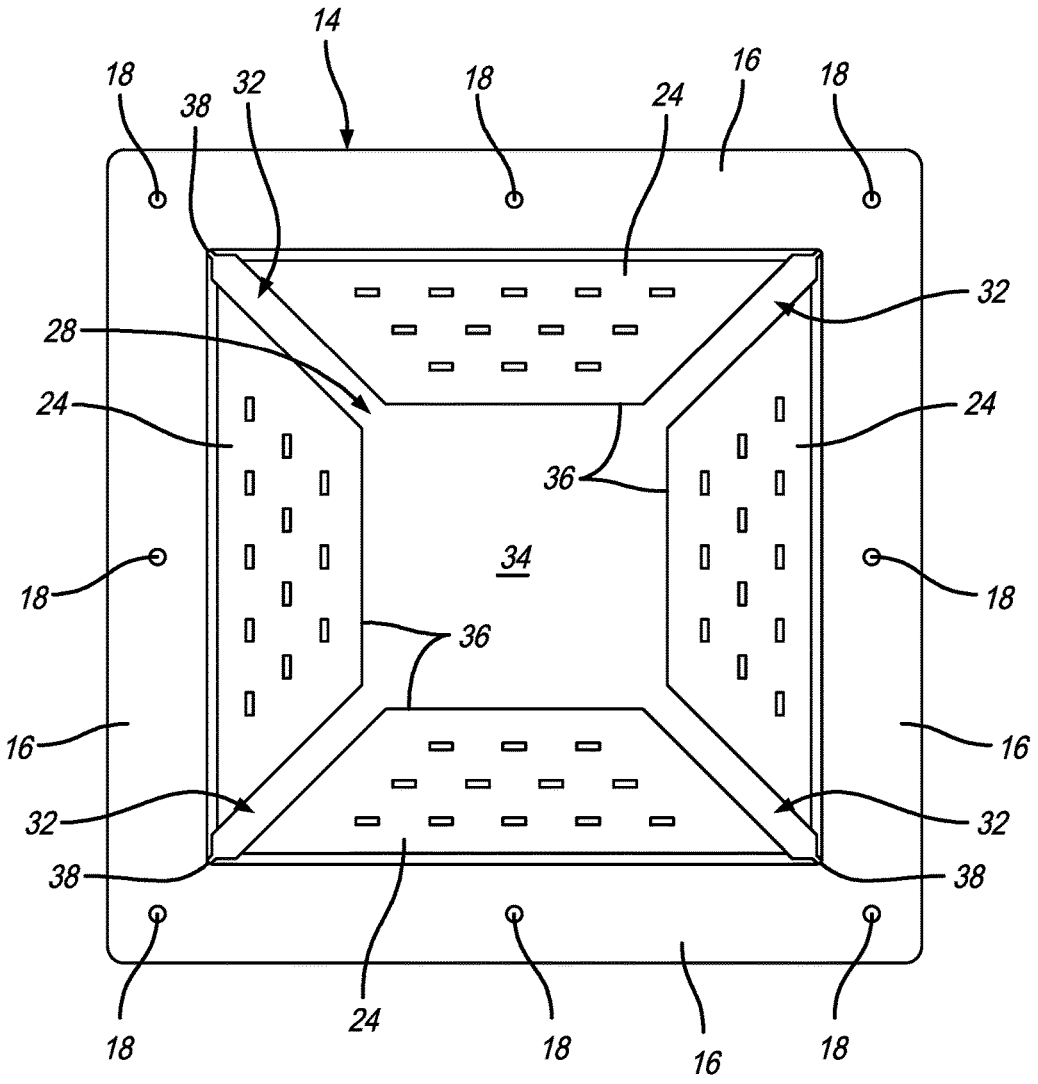
FIG. 11 is a bottom view of the tray portion of FIG. 10.

Top and bottom views of tray 14 are shown in FIGS. 10 and 11, respectively. Both of these views further illustrate the construction of tray 14, particularly as being made from a metal material such as 24 gauge galvanized steel. To that end, both views show vertexes 38 and slots 32 that extend to opening 34. It is also appreciated that the dimensions of this tray may be 12 inches by 12 inches. It is appreciated that the dimensions may be changed based on the size of the hole needed to be filled. In an embodiment the plug member may be 11⅞ inch square or 7⅞ inch square to fit in cavity 28 depending on the needed plug size. Illustratively the flanges extend about 4 inches from cavity 28. We identify the products as 8" and 12"—these numbers are the width and length of the hole filled (i.e. the size of the OSB plug and dimension of the recessed portion of the tray). Technically, the wood pieces are 7⅞" and 11⅞" to accommodate 8" and 12" holes. The outer dimensions from flange to flange are 12" and 16" respectively.]

It is believed that this roof plug assembly embodiment as well as other embodiments might include one or more of the following advantages: sturdy flanges not susceptible to waving or flex in light of the steel tray; the tray being able to accept standard cut roof plugs by having square corners; square corners that eliminate gaps that would allow water to enter; easy attachment to the roof using pre-formed fastener or nail holes; displays plug member from underneath to allow inspection through open underside tray; easy securement of plug member to tray using pre-installed barbs or like fasteners that eliminate the need for adhesives, staples, or other fastening means; more durable and resilient tray when using metal rather than plastic; and increased weight capacity from about 600 to about 700 pounds is believed achievable using a metal tray; a longer lifetime bond for the plug member is believed achievable using barbs as the attachment means rather than glue; a better fastening means in cyclical hot/cold weather environments is also believed achievable using barbs as the attachment means; eliminates perception the hole was patched with sheet metal, and is believed to possibly reduce or eliminate condensation on the backside of the plug during cold temperatures.

Another illustrative embodiment of the present disclosure includes a smaller-dimensioned roof plug assembly 50. Such a roof plug assembly 50 may have an 8-inch dimension rather than a 12 inch dimension. It is appreciated that the characteristics of the 8 and 12 inch roof plugs may be interchanged depending on particular needs. The 8 inch plug assembly shown herein is for illustrative purposes depicting what changes may be made based on different dimensions.

Figure 12:
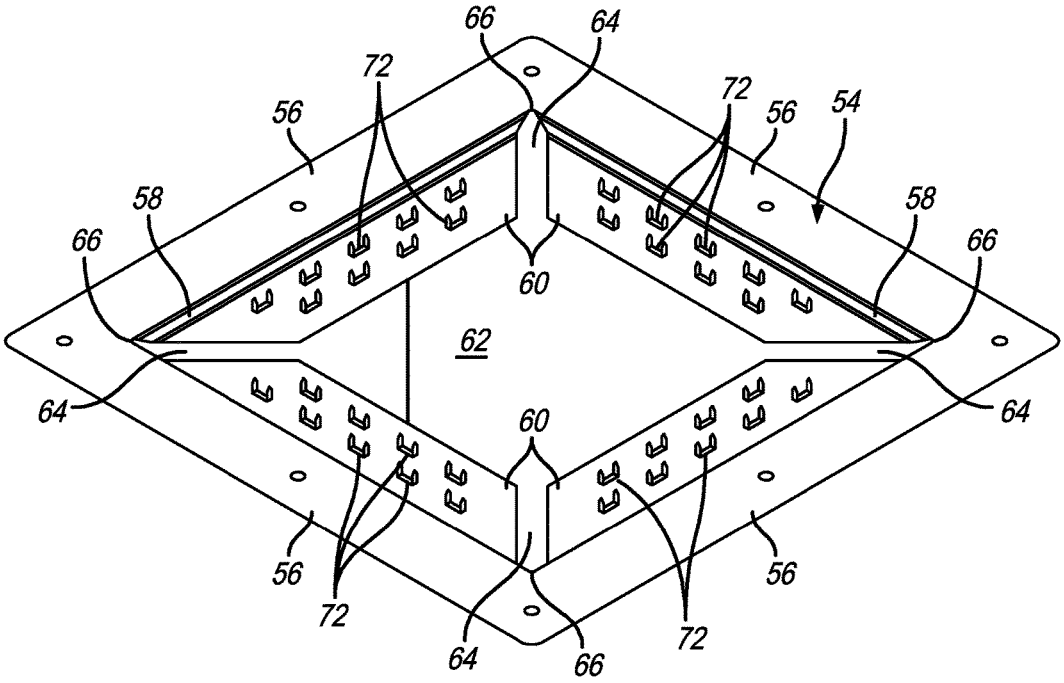
FIG. 12 is a perspective view of a tray from another illustrative embodiment of a roof plug assembly.
Figure 13:
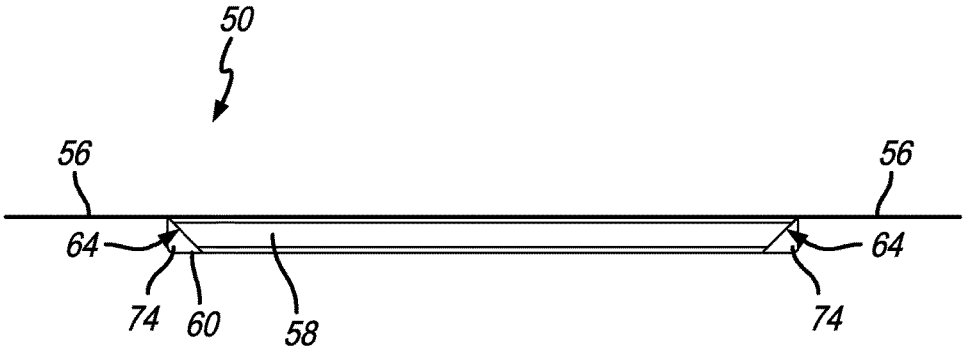
FIG. 13 is a side view of the plug assembly referred to in FIG. 12.
Figure 14:
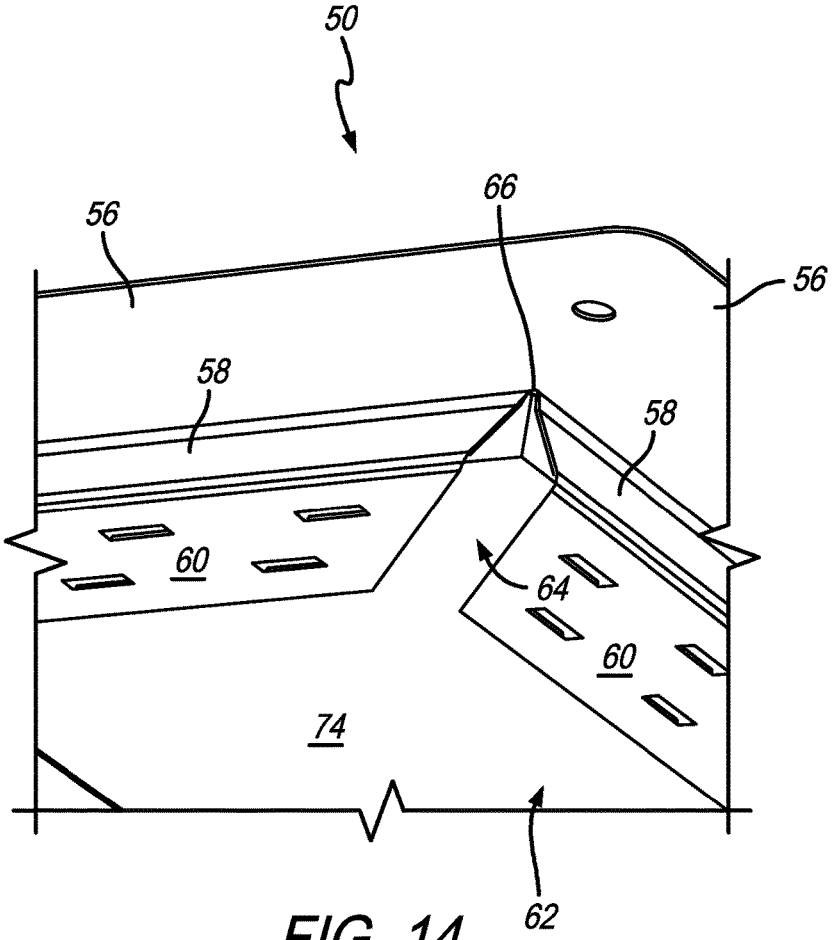
FIG. 14 is a perspective detail view of a portion of the tray of FIG. 12.

Top perspective, side, and underside perspective detail views of the alternate 8 inch plug assembly 50 are shown in FIGS. 12, 13, and 14, respectively. The top perspective view of FIG. 12 shows tray portion 54 of plug 50 that includes similar flanges 56, side walls 58 and support bases 60 to the corresponding structures discussed in the prior embodiment. Despite being a different size, tray 54 still includes an opening 62 and slots 64 extending between opening 62 and vertexes 66 at the corners of cavity 68. A distinction from tray 14 is that in tray 54 there are fewer rows of barbs 72 extending upward from support base 60. It is appreciated, however, that the number of rows and/or orientations of barbs or other fastening structures may be modified to suit the particular needs for the plug member that will fit in cavity 68.

The side view of plug assembly 50 is shown in FIG. 13. It is appreciated that such a side view of plug 50 is substantially similar to what the side profile of plug assembly 10 would look like. It is appreciated in this view how plug member 74 is positioned essentially flush with flanges 56. Also because of vertexes 68 and channel 64, plug member 74 may be cut in straight lines and having right angle corners, yet still fit in the metal tray. As previously discussed, such a manner forming a plug member is believed to be the easiest. It can be further appreciated in this view, how dependent side wall 58 accommodates for the thickness of plug member 74.

An underside perspective detail view of plug assembly 50 is shown in FIG. 14. This view helps to further illustrate how plug member 74 fits into cavity 68 (see FIG. 12) and is supported by support member 60. This view also emphasizes how plug member 74 may be clearly visible from the underside of plug assembly 50 which may be useful during roof inspection after construction.

Although certain embodiments have been described and illustrated in exemplary forms with a certain degree of particularity, it is noted that the description and illustrations have been made by way of example only. Numerous changes in the details of construction, combination, and arrangement of parts and operations may be made. Accordingly, such changes are intended to be included within the scope of the disclosure.

What is claimed:

1. A roof plug assembly comprising:

a plug member;

a tray member that includes a recessed portion and a flange portion;

wherein the tray member is made of a rigid galvanized steel;

wherein the recessed portion includes a base having at least one opening disposed therein;

wherein the base is composed of a plurality of panels such that at least a portion of each the plurality of panels is spaced apart from each other;

wherein space between each of the plurality of panels form the at least one opening disposed in the base;

wherein the recessed portion includes a plurality of side walls each extending upwardly from one of the plurality of panels of the base to the flange portion; and a plurality of upward extending barbs located on each of the plurality of panels and extending into the recessed portion;

wherein the flange portion is oriented outward from a top edge of the plurality of side walls of the recessed portion;

wherein the flange portion connects to the plurality of panels via the plurality of sidewalls;

wherein the flange portion includes a plurality of fastener holes disposed therein and configured to receive fasteners that secure the roof plug assembly onto a roof;

wherein the plug member fits into the recessed portion and is supported by the plurality of panels;

wherein the plurality of upward extending barbs extend into the plug member to secure it to the recessed portion; and wherein the at least one opening in the base provides visual inspection of the plug member when located in the recessed portion.

2. The roof plug assembly of claim 1, wherein the recessed portion has a polygonal profile.

3. The roof plug assembly of claim 1, wherein the recessed portion has a profile selected from the group consisting of square and rectangular.

4. The roof plug assembly of claim 1, wherein the plurality of fastener holes are sized to receive a fastener selected from the group consisting of a screw, nail, pin, staple, and bolt.

5. The roof plug assembly of claim 1, wherein the plug member made of a material selected from the group consisting of OSB, MDF, solid wood, particleboard, plywood, chipboard, and cellulose-based.

6. The roof plug assembly of claim 1, wherein the tray member is made of a galvanized steel in a gauge that is thick enough to prevent the flange portions from flexing.

7. The roof plug assembly of claim 1, wherein the recessed portion includes corners composed of right angles.

8. A roof plug assembly comprising:

a plug member;

a tray member that includes a recessed portion and a flange portion;

wherein the tray member is made of a rigid material;

wherein the recessed portion includes a base having at least one opening disposed therein;

wherein the recessed portion includes a plurality of side walls each extending upwardly from the base to the flange portion; and wherein the flange portion is oriented outward from a top edge of the plurality of side walls of the recessed portion;

wherein the flange portion is made of the rigid material so that the flange portion is a rigid structure;

wherein the plug member fits into the recessed portion; and wherein the at least one opening in the base provides visual inspection of the plug member when located in the recessed portion.

9. The roof plug assembly of claim 8, wherein the tray member is made of steel.

10. The roof plug assembly of claim 8, wherein the base is composed of a plurality of panels such that at least a portion of each the plurality of panels is spaced apart from each other; and wherein space between each of the plurality of panels form the at least one opening disposed in the base.

11. The roof plug assembly of claim 8, further comprising a plurality of upward extending barbs located on the base and extending into the recessed portion; and wherein the plurality of upward extending barbs extend into the plug member to secure it to the recessed portion.

12. The roof plug assembly of claim 8, wherein the flange portion includes a plurality of fastener holes disposed therein configured to receive fasteners that secure the roof plug assembly onto a roof.

13. The roof plug assembly of claim 8, wherein the recessed portion includes corners composed of right angles.

14. The roof plug assembly of claim 8, wherein the plug member made of a material selected from the group consisting of OSB, MDF, solid wood, particleboard, plywood, chipboard, and cellulose-based.

15. A roof plug assembly comprising:

a plug member;

a tray member that includes a recessed portion and a flange portion;

wherein the tray member is made of a rigid material;

wherein the recessed portion includes a base composed of a plurality of panels such that at least a portion of each the plurality of panels is spaced apart from each other to form a space between each of the plurality of panels;

wherein the recessed portion includes a plurality of side walls each extending upwardly from one of the plurality of panels of the base to the flange portion; and wherein the flange portion is oriented outward from a top edge of the plurality of side walls of the recessed portion;

wherein the flange portion connects to the plurality of panels via the plurality of sidewalls;

wherein the plug member fits into the recessed portion and is supported by the plurality of panels.

* * * * *